US007192259B2

(12) United States Patent
Lee

(10) Patent No.: US 7,192,259 B2
(45) Date of Patent: Mar. 20, 2007

(54) VARIABLE CAPACITY ROTARY COMPRESSOR

(75) Inventor: Jeong Bae Lee, Suwon (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 159 days.

(21) Appl. No.: 11/102,853

(22) Filed: Apr. 11, 2005

(65) Prior Publication Data

US 2006/0034720 A1 Feb. 16, 2006

(30) Foreign Application Priority Data

Aug. 10, 2004 (KR) ..... 10-2004-0062744

(51) Int. Cl.
*F01C 20/22* (2006.01)

(52) U.S. Cl. ..... 418/29; 418/60; 417/218; 417/221; 417/410.3

(58) Field of Classification Search ..... 418/29, 418/60, 69; 417/218, 410.3, 221, 287
See application file for complete search history.

(56) References Cited

U.S. PATENT DOCUMENTS

| | | | | |
|---|---|---|---|---|
| 5,951,261 | A | 9/1999 | Paczuski | |
| 6,796,773 | B1 * | 9/2004 | Choi et al. | 417/218 |
| 6,860,724 | B2 * | 3/2005 | Cho et al. | 417/218 |
| 6,935,853 | B2 * | 8/2005 | Lee et al. | 418/60 |
| 6,962,486 | B2 * | 11/2005 | Lee et al. | 417/218 |
| 7,059,842 | B2 * | 6/2006 | Lee et al. | 418/60 |
| 7,070,395 | B2 * | 7/2006 | Lee et al. | 417/218 |
| 7,104,764 | B2 * | 9/2006 | Lee et al. | 417/218 |
| 2004/0071560 | A1 * | 4/2004 | Cho et al. | 417/223 |
| 2004/0241010 | A1 * | 12/2004 | Cho et al. | 417/274 |
| 2005/0002815 | A1 * | 1/2005 | Choi et al. | 418/26 |
| 2005/0019191 | A1 * | 1/2005 | Lee et al. | 418/23 |
| 2005/0019192 | A1 * | 1/2005 | Lee et al. | 418/23 |
| 2005/0053506 | A1 * | 3/2005 | Cho et al. | 418/23 |
| 2005/0058562 | A1 * | 3/2005 | Lee et al. | 418/23 |
| 2005/0063849 | A1 * | 3/2005 | Cho et al. | 418/23 |
| 2005/0079071 | A1 * | 4/2005 | Cho et al. | 417/410.3 |
| 2005/0129551 | A1 * | 6/2005 | Cho et al. | 418/30 |
| 2005/0207925 | A1 * | 9/2005 | Cho et al. | 418/29 |

FOREIGN PATENT DOCUMENTS

| | | | |
|---|---|---|---|
| KR | 2001-0022907 | A | 3/2001 |
| KR | 2002-0034883 | A | 5/2002 |

* cited by examiner

*Primary Examiner*—Thomas Denion
*Assistant Examiner*—Mary A. Davis
(74) *Attorney, Agent, or Firm*—Sughrue Mion, PLLC

(57) ABSTRACT

A variable capacity rotary compressor with upper and lower compression chambers having different capacities, the upper and lower compression chambers being partitioned from each other, and a rotary shaft extending through the upper and lower compression chambers. The rotary shaft includes a fixing hole and a latch pin which includes a head part is fixed to the rotary shaft through the fixing hole. The head part of the latch pin can be forcibly fit into a forcible fitting hole of the fixing hole. The head part is spaced apart from the inner circumference of the forcible fitting hole in the axial direction of the rotary shaft when the head part is forcibly fitted in the forcible fitting hole, so that a forcible fitting force is not applied in the axial direction of the rotary shaft.

10 Claims, 10 Drawing Sheets

VARIABLE CAPACITY ROTARY COMPRESSOR

CROSS-REFERENCE TO RELATED APPLICATION

This application claims the benefit of Korean Patent Application No. 2004-62744, filed on Aug. 10, 2004 in the Korean Intellectual Property Office, the disclosure of which is incorporated herein by reference.

FIELD OF THE INVENTION

The present invention relates to a rotary compressor and, more particularly, to a variable capacity rotary compressor that is capable of selectively performing compression in one of two compression chambers with different capacities by means of an eccentric unit disposed at a rotary shaft, thereby varying capacity of the rotary compressor.

DESCRIPTION OF THE RELATED ART

A cooling apparatus, which is used to cool an environment by means of a refrigerating cycle, such as an air conditioner or a refrigerator, has a compressor that compresses a refrigerant circulating in a closed circuit of the refrigerating cycle. The cooling capability of such a cooling apparatus is set on the basis of the compression capacity of the compressor. Consequently, when the compression capacity of the compressor is variable, the cooling apparatus is optimally operated on the basis of the difference between the environmental temperature and the set temperature so that the environment is effectively cooled. As a result, energy consumption is reduced.

Compressors used for the cooling apparatus may be classified into a rotary compressor and a reciprocating compressor. The rotary compressor, to which the present invention is applied, will be described below.

The conventional rotary shaft extending through the rotor; an eccentric cam integrally formed with the rotary shaft; and a roller disposed on the outer circumference of the eccentric cam in a compression chamber. As the rotary shaft is rotated, the eccentric cam and the roller are eccentrically rotated in the compression chamber with the result that gas is introduced into the compression chamber, where the gas is compressed. The compressed gas is then discharged out of the hermetically sealed container.

The conventional rotary compressor with the above-stated construction has a fixed compression capacity. As a result, the compression capacity is not adjusted on the basis of the difference between the environmental temperature and the set temperature.

When the environmental temperature is much higher that the set temperature, it is necessary that the compressor be operated with a large compression capacity to rapidly cool the environment. When the difference between the environmental temperature and the set temperature is slight, on the other hand, it is necessary that the compressor be operated with a small compression capacity to reduce energy consumption. However, the conventional rotary compressor is constantly operated with a fixed compression capacity irrespective of the difference between the environmental temperature and the set temperature. Consequently, the conventional rotary compressor is not optimally operated according to change in the environmental temperature with the result that energy is wasted.

SUMMARY OF THE INVENTION

Therefore, it is an aspect of the invention to provide a variable capacity rotary compressor that is capable of selectively performing compression in one of two compression chambers with different capabilities by means of an eccentric unit disposed at a rotary shaft, there by varying capacity of the rotary compressor.

It is another aspect of the invention to provide a variable capacity rotary compressor that is capable of preventing flexural deformation of the rotary shaft.

In accordance with one aspect, the present invention provides a variable capacity rotary compressor comprising: upper and lower compression chambers having different capacities, the upper and lower compression chamber being partitioned from each other; a rotary shaft extending through the upper and lower compression chambers; upper and lower eccentric cams fitted on the rotary shaft while being eccentric from the rotary shaft, the upper and lower eccentric cams being disposed in the upper and lower compression chambers, respectively; upper and lower eccentric bushes disposed on the outer circumferences of the upper and lower eccentric cams, respectively; a slot defined between the upper and lower eccentric bushes; a latch pin adapted to be latched to one of both ends of the slot depending upon the rotation direction of the rotary shaft, the latch pin comprising a head part; and a fixing hole formed at the rotary shaft for allowing the latch pin to be fixed to the rotary shaft therethrough, the fixing hole comprising a forcible fitting hole for allowing the head part of the latch pin to be forcibly fitted therein; wherein the head part is spaced apart from the inner circumference of the forcible fitting hole in the axial direction of the rotary shaft when the head part is forcibly fitted in the forcible fitting hole, where by a forcible fitting force is not applied in the axial direction of the rotary shaft.

The forcible fitting hole has an elliptical section with a large diameter extending in parallel with the axial direction of the rotary shaft.

The head part is tapered such that the diameter of the head part is gradually increased from the inner end to the outer end thereof.

The latch pin further comprises a male screw part, and the fixing hole further comprises a female screw part for allowing the male screw part of the latch pin to be screwed thereinto.

The forcible fitting hole has a circular section with partial elliptical sections extending in the axial direction of the rotary shaft.

In accordance with one aspect, the present invention provides a variable capacity rotary compressor comprising; upper and lower compression chambers having different capacities, the upper and lower compression chambers being partitioned from each other; a rotary shaft extending through the upper and lower compression chambers; upper and lower eccentric cams fitted on the rotary shaft while being eccentric from the rotary shaft, the upper and lower eccentric cams being disposed in the upper and lower compression chambers, respectively; upper and lower eccentric bushes disposed on the outer circumferences of the upper and lower eccentric cams, respectively; a slot defined between the upper and lower eccentric bushes; a latch pin adapted to be latched to one of both ends of the slot depending upon the rotation direction of the rotary shaft the patch pin comprising a head part; and a fixing hole formed at the rotary shaft for allowing the latch pin to be fixed to the rotary shaft therethrough, the fixing hole comprising a forcible fitting hole for allowing the head part of the latch pin to be forcibly fitted therein; wherein the forcible fitting hole has a vertical length extending in the axial direction of the rotary shaft greater than a horizontal length extending in the circumferential direction of the rotary shaft.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE ILLUSTRATIVE NON-LIMITING EMBODIMENTS

Figure 1:
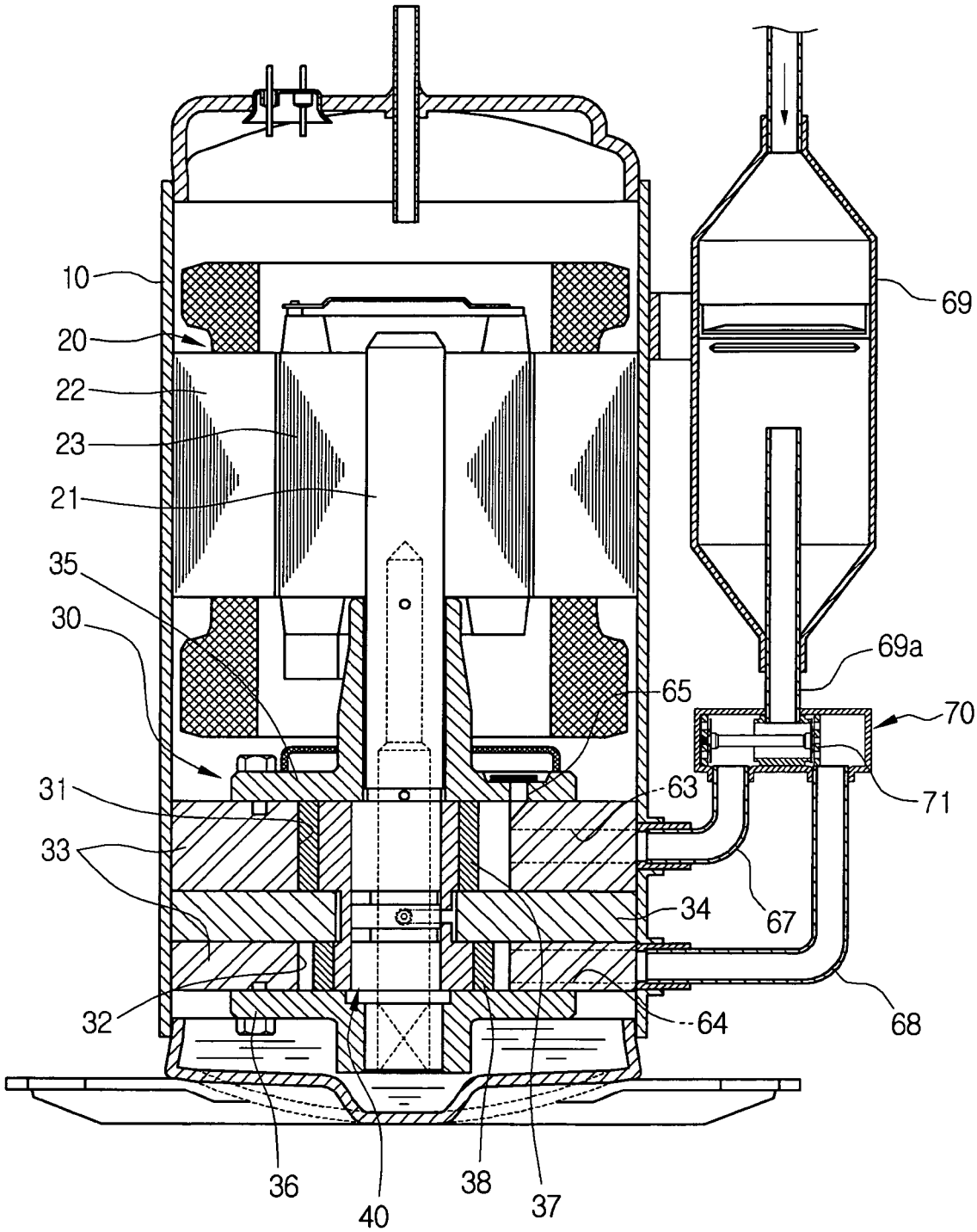
FIG. 1 is a longitudinal sectional view showing the interior structure of a variable capacity rotary compressor according to an exemplary embodiment of the present invention.

Reference will now be made in detail to exemplary embodiments of the present invention, examples of which are illustrated in the accompanying drawings, wherein like reference numerals refer to like elements throughout. The described exemplary embodiments are intended to assist the understanding of the invention, and are not intended to limit the scope of the invention in any way.

FIG. 1 is a longitudinal sectional view showing the interior structure of a variable capacity rotary compressor according to an exemplary embodiment of the present invention. As is shown in FIG. 1, the variable capacity rotary compressor comprises: a driving unit 20 disposed in a hermetically sealed container 10 for generating a rotary force; and a compressing unit 30 to compress gas by means of the rotary force of the driving unit 20. The driving unit 20 comprises: a cylindrical stator 22 disposed in the hermetically sealed container 10; a rotor 23 rotatably disposed in the stator 22; and a rotary shaft 21 extending from the center of the rotor 23 for performing a forward rotation (in a first rotational direction) or a reverse rotation (in a second rotational direction) along with the rotor 23.

The compressing unit 30 comprises: a housing 33 having a cylindrical upper compression chamber 31 defined in the upper part thereof and a cylindrical lower compression chamber 32 defined in the lower part thereof, the upper and lower compression chambers 31 and 32 having different capacities; upper and lower flanges 35 and 36 disposed at the upper and lower ends of the housing 33 for rotatably supporting the rotary shaft 21; and an intermediate plate 34 disposed between the upper and lower compression chambers 31 and 32 for partitioning the upper and lower compression chambers 31 and 32.

The height of the upper compression chamber 31 is greater than the height of the lower compression chamber 32. Consequently, the capacity of the upper compression chamber 31 is greater than the capacity of the lower compression chamber 32 with the result that a larger amount of gas is compressed in the upper compression chamber 31 than in the lower compression chamber 32. In other words, the rotary compressor according to an exemplary embodiment of the present invention has a variable capacity.

Alternatively, the height of the lower compression chamber 32 may be greater than the height of the upper compression chamber 31. In this case, the capacity of the lower compression chamber 32 is greater than the capacity of the upper compression chamber 31 with the result that a larger amount of gas is compressed in the lower compression chamber 32 than in the upper compression chamber 31.

In the upper and lower compression chambers 31 and 32 is disposed an eccentric unit 40 that allows selective compression in one of the upper and lower compression chambers 31 and 32 depending upon the rotation direction of the rotary shaft 21, the construction and operation of which will be described below with reference to FIGS. 2 to 8.

In the upper and lower compression chambers 31 and 32 are mounted upper and lower rollers 37 and 38, respectively, which are rotatably disposed on the outer circumference of the eccentric unit 40. At the housing 33 are formed upper and lower inlets 63 and 64 and upper and lower outlets 65 and 66, which communicate with the upper and lower compression chambers 31 and 32, respectively (Refer to FIGS. 5 and 7).

Figure 5:
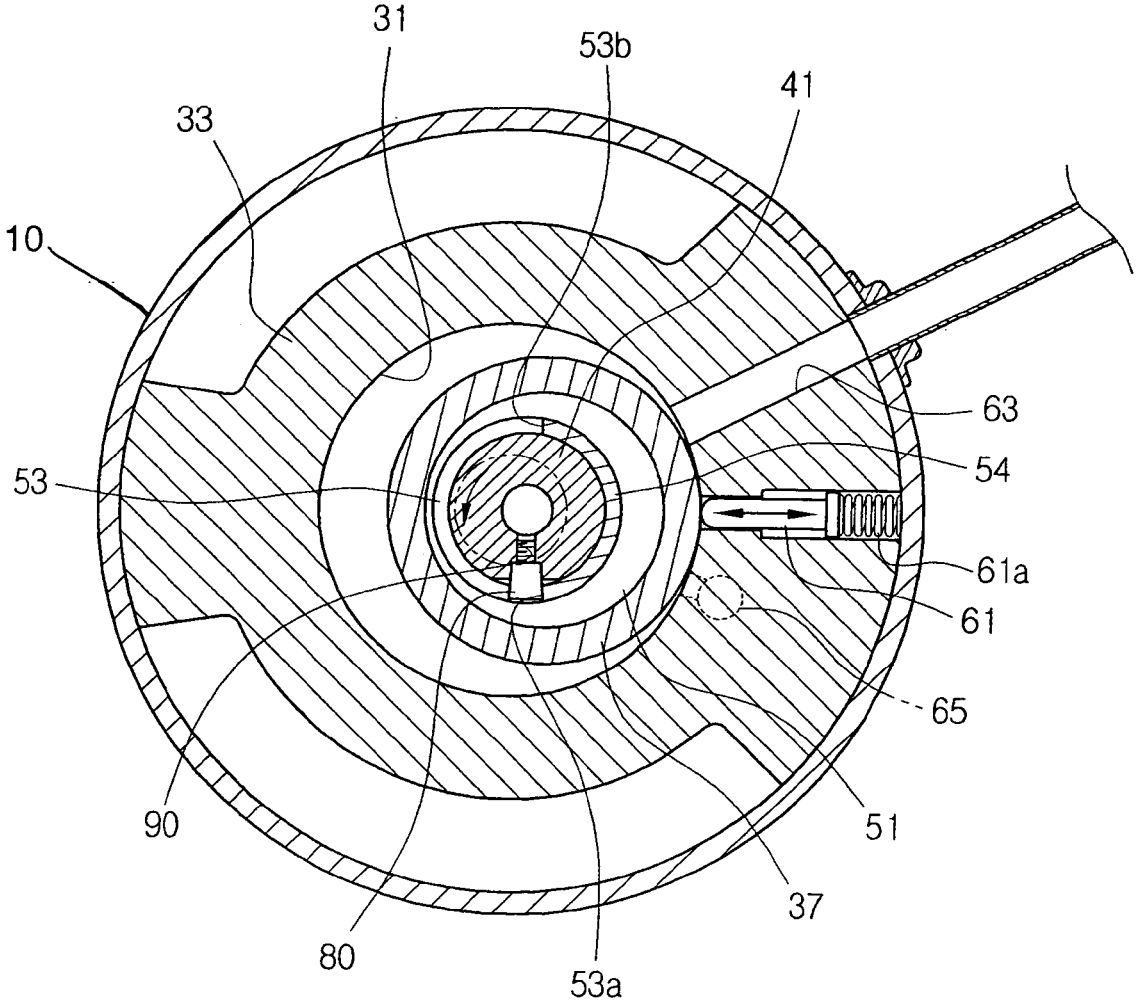
FIG. 5 is a cross-sectional view showing that compression is performed in an upper compression chamber by means of the eccentric unit as the rotary shaft is rotated in a first rotating direction.

Between the upper inlet 63 and the upper outlet 65 is disposed an upper vane 61, which is pressed against the upper roller 37 by means of a supporting spring 61*a*, in the radial direction of the hermetically sealed container 10 (Refer to FIG. 5). Between the lower inlet 64 and the lower outlet 66 is disposed a lower vane 62, which is pressed against the lower roller 38 by means of a supporting spring 62*a*, in the radial direction of the hermetically sealed container 10 (Refer to FIG. 7).

At a discharging pipe 69*a* of an accumulator 69, to allow only a gas refrigerant separated from a liquid refrigerant to be introduced into the compressor, is disposed a channel switching unit 70 to selectively open/close introducing channels 67 and 68 such that the gas refrigerant is supplied to one of the upper and lower inlets 63 and 64 formed at the housing 33, specifically to the inlet where a compression operation is carried out. In the channel switching unit 70 is mounted a valve 71 to open one of the introducing channels 67 and 68 and supply the gas refrigerant on the basis of the pressure difference between the introducing channel 67 connected to the upper inlet 63 and the introducing channel 68 connected to the lower inlet 64 while being movable horizontally.

Figure 2:
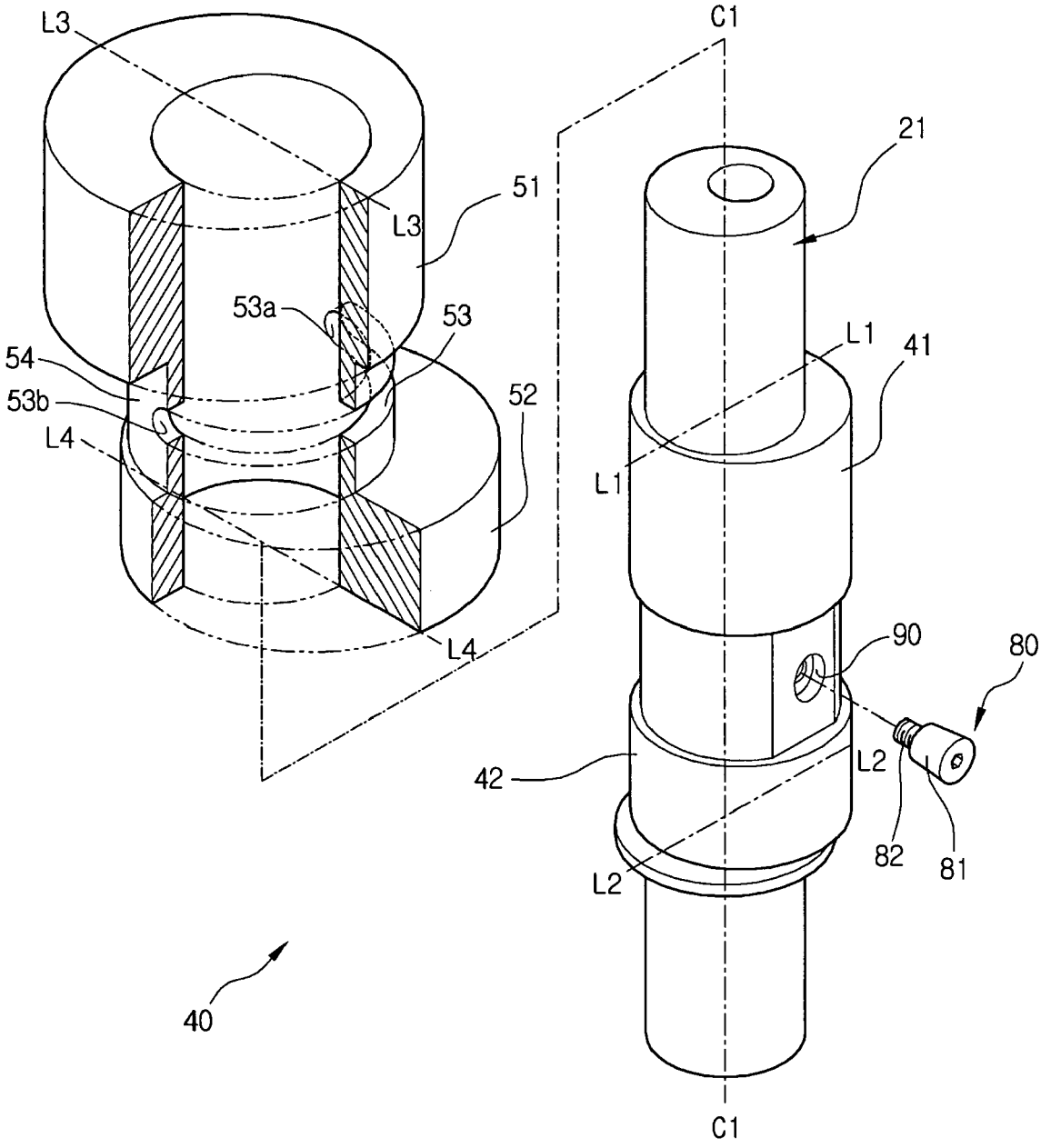
FIG. 2 is an exploded perspective view showing an eccentric unit detached from a rotary shaft of the variable capacity rotary compressor of FIG. 1.

As is shown in FIG. 2, the eccentric unit 40 comprises: upper and lower eccentric cams 41 and 42 fitted on the rotary shaft 21 while corresponding to the upper and lower compression chambers 31 and 32, respectively; upper and lower eccentric bushes 51 and 52 disposed on the outer circumferences of the upper and lower eccentric cams 41 and 42, respectively; a latch pin 80 disposed between the upper and lower eccentric cams 41 and 42; and a slot 53 defined between the upper and lower eccentric bushes 51 and 52 while extending by a predetermined length for latching the latch pin 80 at either end of the slot 53 as the rotary shaft 21 is rotated in a forward or reverse direction such that the latch pin 80 performs a clutching operation.

The upper and lower eccentric cams 41 and 42 are protruded outwardly from the outer circumference of the rotary shaft 21, and disposed vertically while being eccentric about a center line C1—C1 of the rotary shaft 21. Also, the upper and lower eccentric cams 41 and 42 are disposed such that an upper eccentric line L1—L1 connected between a maximum eccentric part of the upper eccentric cam 41, which is maximally protruded from the rotary shaft 21, and a minimum eccentric part of the upper eccentric cam 41, which is minimally protruded from the rotary shaft 21, corresponds to a lower eccentric line L2—L2 connected between a maximum eccentric part of the lower eccentric cam 42, which is maximally protruded from the rotary shaft 21, and a minimum eccentric part of the lower eccentric cam 42, which is minimally protruded from the rotary shaft 21.

The longitudinal length of the upper eccentric cam 41 is equal to the height of the upper compression chamber 31. Similarly, the longitudinal length of the lower eccentric cam 42 is equal to the height of the lower compression chamber 32.

The latch pin 80 comprises a head part 81 and a male screw part 82 extending a predetermined length from the head part 81. The male screw part 82 has a thread formed at the outer circumference thereof. The latch pin 80 is fixed in a fixing hole 90 formed at the rotary shaft 21 between the upper and lower eccentric cams 41 and 42 while being at an angle of approximately 90 degrees to the eccentric lines L1—L1 and L2—L2 such that the latch pin 80 is attached to the rotary shaft 21. Fixing of the latch pin 80 in the fixing hole 90 of the rotary shaft 21 will be described in detail below.

The upper eccentric bush 51, which has a longitudinal length corresponding to the upper eccentric cam 41, and the lower eccentric bush 52, which has a longitudinal length corresponding to the lower eccentric cam 42, are integrally connected to each other by means of a connection part 54. The slot 53 has a width slightly greater than the diameter of the head part 81 of the latch pin 80, and is formed at the connection part 54 in the circumferential direction of the connection part 54.

The upper and lower eccentric bushes 51 and 52 integrally connected to each other by means of the connection part 54 are fitted on the rotary shaft 21, and the latch pin 80 is inserted into the fixing hole 90 of the rotary shaft 21 through the slot 53. Consequently, the latch pin is attached to the rotary shaft 21 while being inserted through the slot 53.

When the rotary shaft 21 is rotated in a forward or reverse direction, the upper and lower eccentric bushes 51 and 52 are not rotated until the latch pin 80 is latched to one of first and second ends 53*a* and 53*b* of the slot 53. When the latch pin 80 is latched to one of first and second ends 53*a* and 53*b* of the slot 53, the upper and lower eccentric bushes 51 and 52 are rotated in the forward or reverse direction along with the rotary shaft 21.

An eccentric line L3—L3 connected between the maximum and minimum eccentric parts of the upper eccentric bush 51 is at an angle of approximately 90 degrees to a line connected between the first end 53*a* of the slot 53 and the center of the connection part 54. Similarly, an eccentric line L4—L4 connected between the maximum and minimum eccentric parts of the lower eccentric bush 52 is at an angle of approximately 90 degrees to a line connected between the second end 53*b* of the slot 53 and the center of the connection part 54.

The eccentric line L3—L3 of the upper eccentric bush 51 and the eccentric line L4—L4 of the lower eccentric bush 52 are placed on the same plane. The maximum eccentric part of the upper eccentric bush 51 is opposite to the maximum eccentric part of the lower eccentric bush 52. A line connected between the first and second ends 53*a* and 53*b* of the slot 53 formed at the connection part 54 in the circumferential direction of the connection part 54 is formed at an angle of 180 degrees.

When the latch pin 80 is latched to the first end 53*a* of the slot 53, the upper eccentric bush 51 is rotated in a first rotating direction along with the rotary shaft 21 (the lower eccentric bush is also rotated). At this time, the maximum eccentric part of the upper eccentric cam 41 contacts the maximum eccentric part of the upper eccentric bush 51 with the result that the upper eccentric bush 51 is rotated in the forward direction while maximally eccentric from the rotary shaft 21 (Refer to FIG. 5). The maximum eccentric part of the lower eccentric cam 42 contacts the minimum eccentric part of the lower eccentric bush 52 with the result that the lower eccentric bush 52 is rotated in the forward direction while being concentric to the rotary shaft 21 (Refer to FIG. 6).

Figure 7:
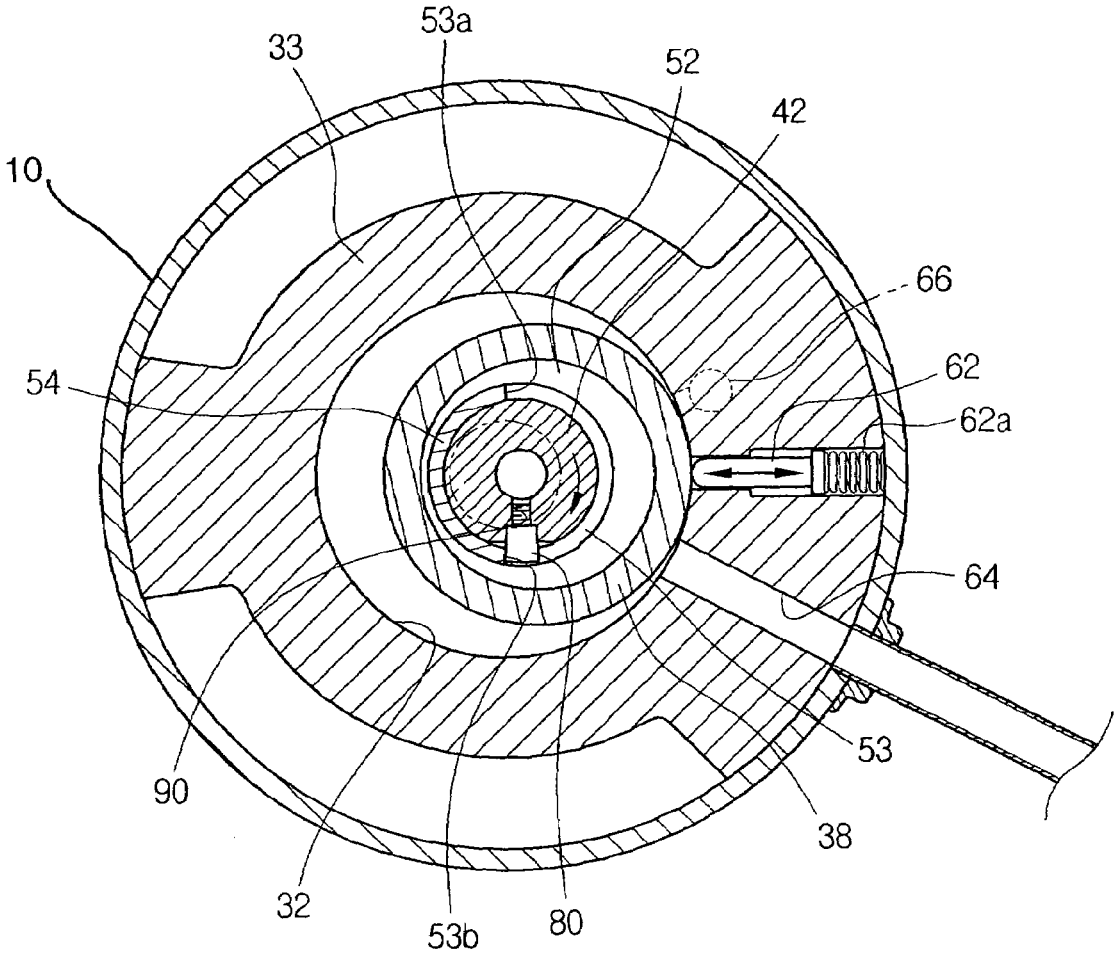
FIG. 7 is a cross-sectional view showing that compression is performed in the lower compression chamber by means of the eccentric unit as the rotary shaft is rotated in a second rotating direction.

When the lower eccentric bush 52 is rotated in a second rotating direction along with the rotary shaft 21 as the latch pin 80 is latched to the second end 53*b* of the slot 53, on the other hand, the maximum eccentric part of the lower eccentric cam 42 contacts the maximum eccentric part of the lower eccentric bush 52 with the result that the lower eccentric bush 52 is rotated in the reverse direction while maximally eccentric from the rotary shaft 21 (Refer to FIG. 7). The maximum eccentric part of the upper eccentric cam 41 contacts the minimum eccentric part of the upper eccentric bush 51 with the result that the upper eccentric bush 51 is rotated in the reverse direction while being concentric to the rotary shaft 21 (Refer to FIG. 8).

A description of how the latch pin 80 is fixed to the rotary shaft 21 will now be given.

Figure 3A:
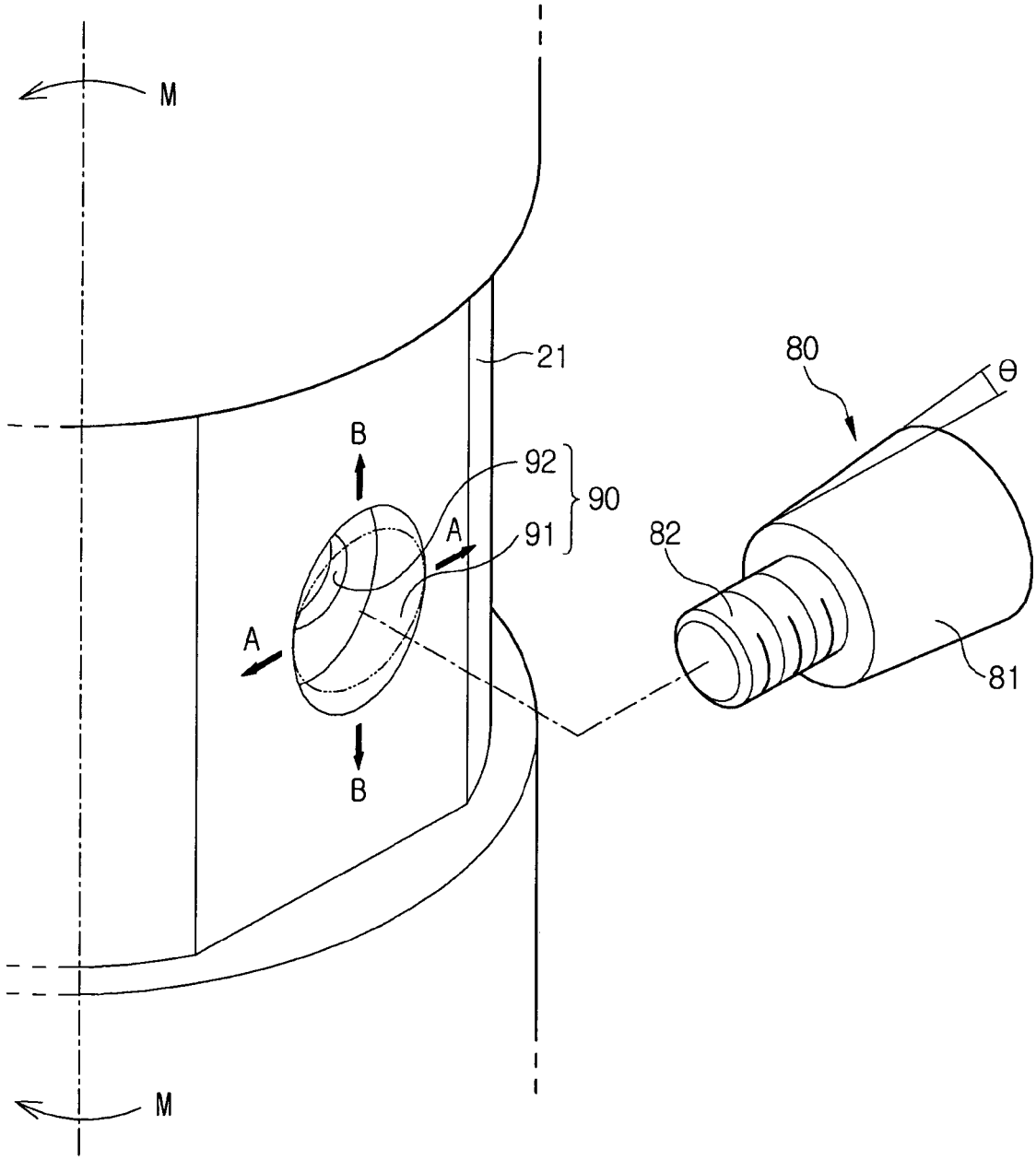
FIG. 3*a* is an exploded perspective view showing how a latch pin is fixed to a rotary shaft of a variable capacity rotary compressor according to an exemplary embodiment of the present invention.
Figure 3B:
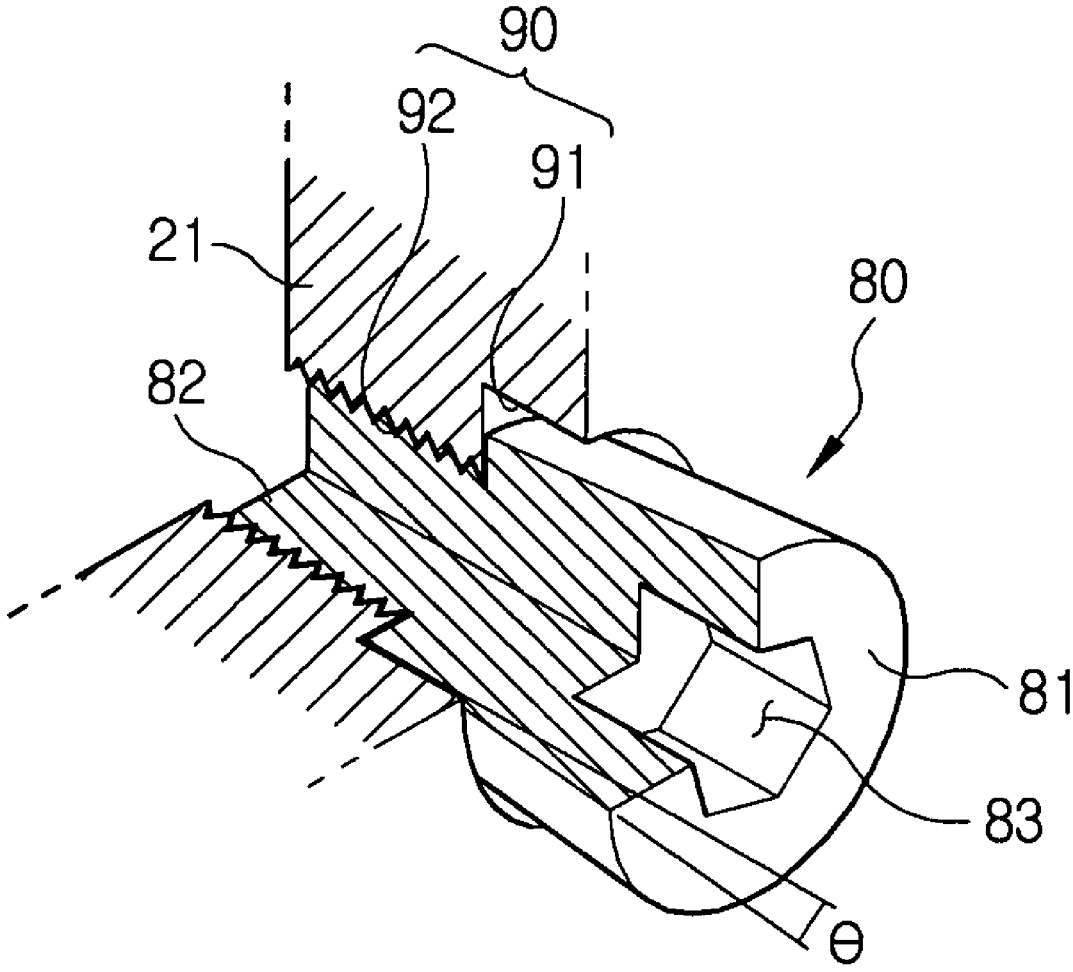
FIG. 3*b* is a cutaway view showing how the latch pin is fixed to the rotary shaft of the variable capacity rotary compressor of FIG. 3*a;*

FIG. 3*a* is an exploded perspective view showing the structures of the latch pin 80 and the rotary shaft 21, and FIG. 3*b* is a cutaway view showing the latch pin 80 fixed to the rotary shaft 21. As is shown in FIGS. 3*a* and 3*b*, the fixing hole 90 is formed at the rotary shaft 21 such that the fixing hole 90 extends inwardly from the outer surface of the rotary shaft 21 toward the center of the rotary shaft 21. The fixing hole 90 comprises: a forcible fitting hole 91, into which the head part 81 of the latch pin 80 is forcibly fitted;

and a female screw part 92 having a thread formed at the inner circumference thereof such that the male screw part 82 of the latch pin 80 can be screwed into the female screw part 92. The head part 81 of the latch pin 80 is provided at the upper surface thereof with a hexagonal groove 83, into which a hex-key is inserted so that the latch pin 80 can be screwed into the fitting hole 90 as the hex-key is rotated while being inserted in the hexagonal groove 83.

The latch pin 80 is securely fixed to the rotary shaft 21 by means of the fitting force between the female screw part 92 and the male screw part 82 and the forcible fitting force between the forcible fitting hole and the head part 81.

In the case that the forcible fitting force is applied in all directions around the head part 81, a component A of the forcible fitting force, which is applied in the circumferential direction of the rotary shaft 21, securely supports the latch pin 80 when the latch pin 80 is latched to the first end 53*a* or the second end 53*b* of the slot 53. On the other hand, a component B of the forcible fitting force, which is applied in the axial direction of the rotary shaft 21, causes flexural deformation of the rotary shaft 21. Specifically, the component B of the forcible fitting force, which is applied in the axial direction of the rotary shaft 21, induces a moment M to the rotary shaft 21, by which the rotary shaft 21 is bent such that both ends of the rotary shaft 21 are positioned away from the latch pin 80, as in shown in FIG. 3A.

The bending of the rotary shaft 21 is not great, so it cannot be perceived with the naked eye. For example, the rotary shaft 21 is bent approximately several tens of μm at either end thereof. However, such deformation of the rotary shaft 21 causes parts of the compressor to be easily worn or the rotary shaft 21 to be improperly rotated, which has a negative effect on reliability of the compressor.

The variable capacity rotary compressor according to an exemplary embodiment of the present invention is characterized in that the forcible fitting hole 91 has an elliptical section so as to prevent the flexural deformation of the rotary shaft 21. Specifically, when the head part 81 of the latch pin 80 is inserted into the forcible fitting hole 91 while the large diameter direction of the elliptical hole 91 is in parallel with the axial direction of the rotary shaft 21, the head part 81 contacts the inner circumference of the forcible fitting hole 91 in the circumferential direction of the rotary shaft 21 while the head part 81 is spaced apart from the inner circumference of the forcible fitting hole 91 in the axial direction of the rotary shaft 21, which is illustrated in FIG. 3*b*. As a result, the forcible fitting force is not applied in the axial direction of the rotary shaft 21.

The head part 81 of the latch pin 80 is tapered such that the forcible fitting operation is facilitated. Specifically, the diameter of the head part 81 is gradually increased from the inner end to the outer end thereof at a predetermined tapering angle 6. Preferably, the tapering angle 6 is set to between approximately 2 and 5 degrees. The forcible fitting hole 91, into which the head part 81 is forcibly fitted, is also tapered at a predetermined tapering angle, which is equal to the tapering angle 8 of the head part 81 of the latch pin 80.

Figure 4A:
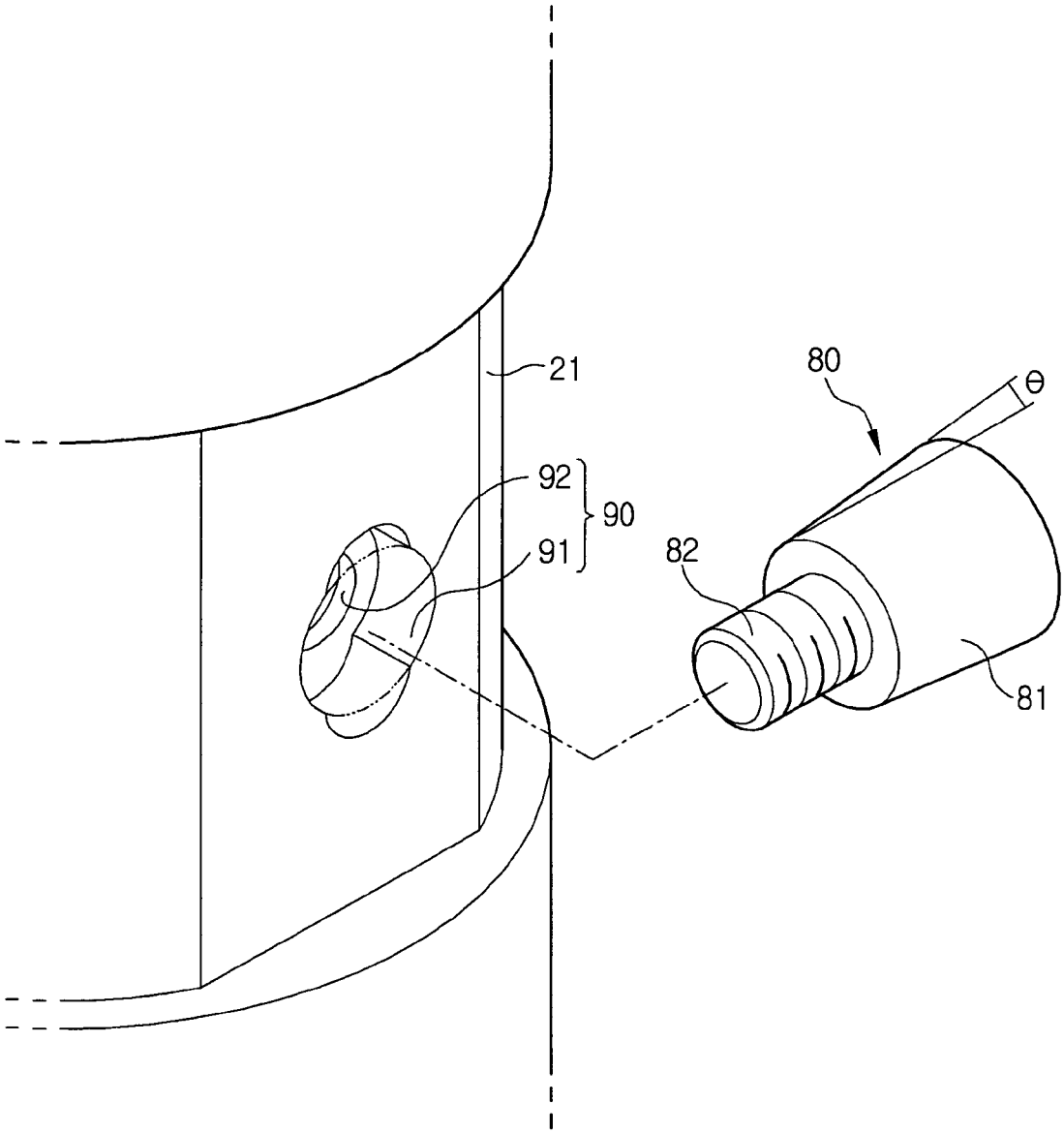
FIG. 4*a* is an exploded perspective view showing how a latch pin is fixed to a rotary shaft of a variable capacity rotary compressor according to another exemplary embodiment of the present invention.
Figure 4B:
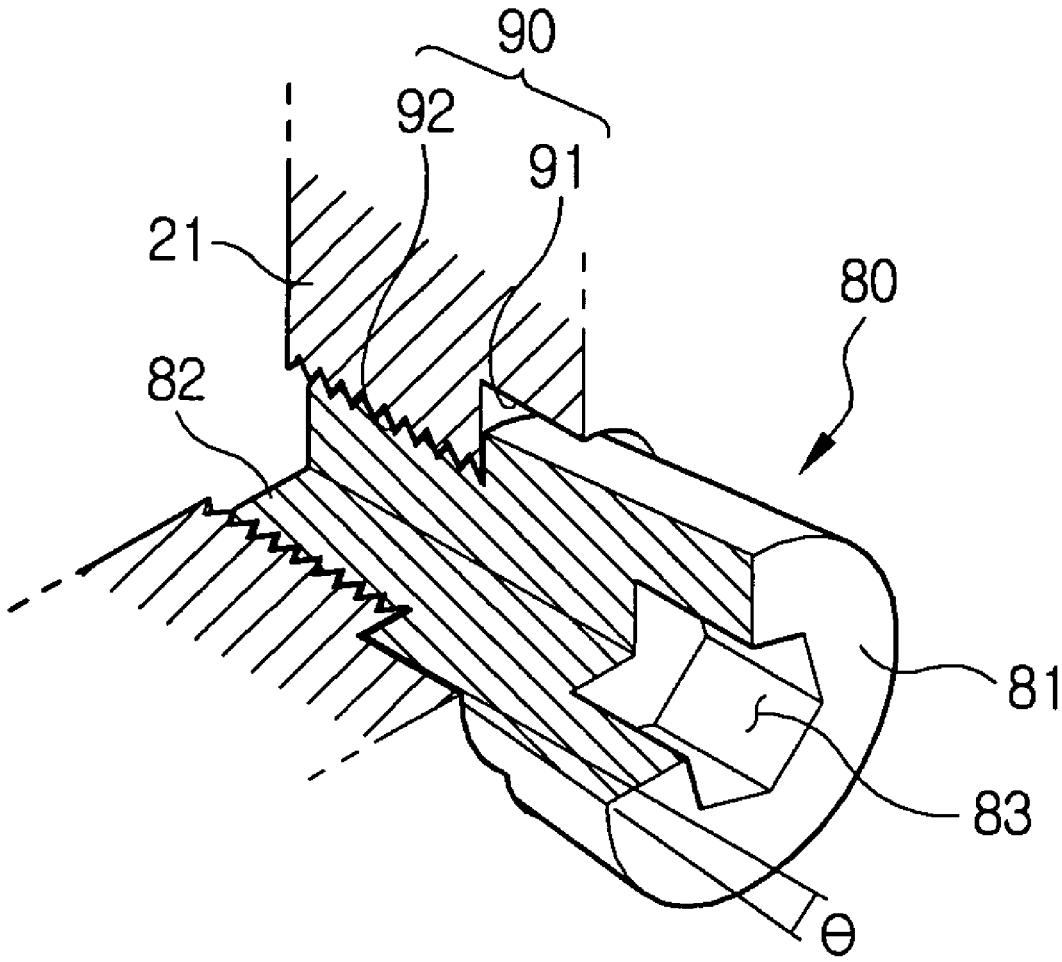
FIG. 4*b* is a cutaway view showing how the latch pin is fixed to the rotary shaft of the variable capacity rotary compressor of FIG. 4*a;*

FIG. 4*a* is an exploded perspective view showing the structures of a latch pin 80 and a rotary shaft 21 of a variable capacity rotary compressor according to another exemplary embodiment of the present invention, and FIG. 4*b* is a cutaway view showing the latch pin 80 fixed to the rotary shaft 21. In this exemplary embodiment, the forcible fitting hole 91 has a circular section with partial elliptical sections extending in the axial direction of the rotary shaft 21. Consequently, the head part 81 is spaced apart from the inner circumference of the forcible fitting hole 91 in the axial direction of the rotary shaft 21, and thus the forcible fitting force is not applied in the axial direction of the rotary shaft 21.

Selective compression of the gas refrigerant in the upper or lower compression chamber through the operation of the eccentric unit constructed as is described above will be described hereinafter with reference to FIGS. 5 to 8.

Figure 6:
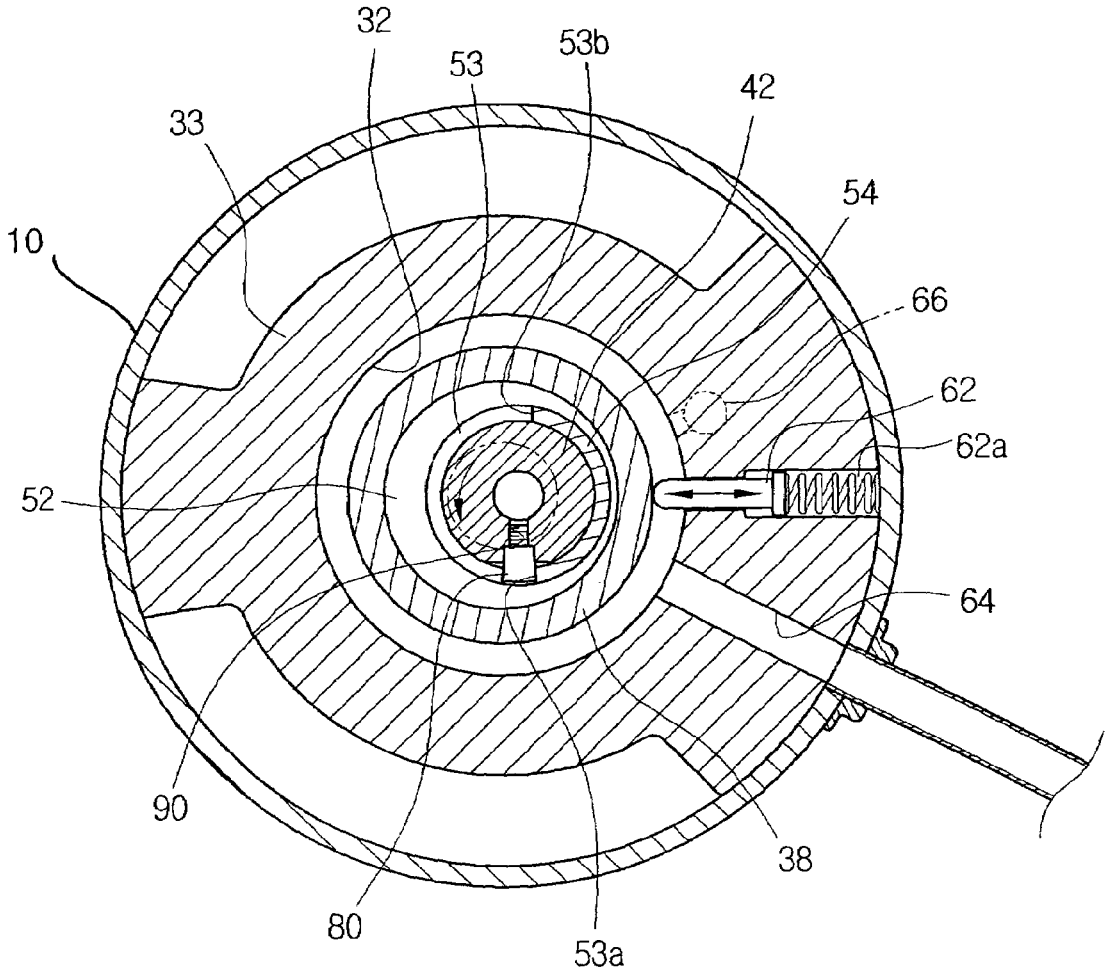
FIG. 6 is equivalent to FIG. 5, showing that compression is not performed in a lower compression chamber by means of the eccentric unit as the rotary shaft is rotated in the first rotating direction.

FIG. 5 is a cross-sectional view showing that compression is performed in the upper compression chamber by means of the eccentric unit as the rotary shaft is rotated in the first rotating direction, and FIG. 6 is equivalent to FIG. 5, showing that compression is not performed in the lower compression chamber by means of the eccentric unit as the rotary shaft is rotated in the first rotating direction.

As is shown in FIG. 5, the latch pin 80 protruded from the rotary shaft 21 is rotated predetermined degrees while being inserted through the slot 53 formed between the upper and lower eccentric bushes 51 and 52 as the rotary shaft 21 is rotated in the first rotating direction (in the counterclockwise direction in FIG. 5). As a result, the latch pin 80, more specifically, the head part 81 of the latch pin 80, is latched to the first end 53*a* of the slot 53. Consequently, the upper eccentric bush 51 is rotated along with the rotary shaft 21.

When the latch pin 80 is latched to the first end 53*a* of the slot 53, the maximum eccentric part of the upper eccentric cam 41 contacts the maximum eccentric part of the upper eccentric bush 51, and thus the upper eccentric bush 51 is rotated while being maximally eccentric from the center line C1—C1 of the rotary shaft 21. As a result, the upper roller 37 is rotated while contacting the inner circumference of the housing 33 defining the upper compression chamber 31, and therefore compression is performed.

At the same time, the maximum eccentric part of the lower eccentric cam 42 contacts the minimum eccentric part of the lower eccentric bush 52, as is shown in FIG. 6, and thus the lower eccentric bush 52 is rotated while being concentric to the center line C1—C1 of the rotary shaft 21. As a result, the lower roller 38 is rotated while being spaced a predetermined distance from the inner circumference of the housing 33 defining the lower compression chamber 32, and therefore compression is not performed.

When the rotary shaft 21 is rotated in the first rotating direction, a gas refrigerant introduced into the upper compression chamber 31 having a relatively large capacity through the upper inlet 63 is compressed by means of the upper roller 37, and is then discharged through the upper outlet 65. On the other hand, the compression is not performed in the lower compression chamber 32 having a relatively small capacity. Consequently, the rotary compressor is operated with a large compression capacity.

Figure 8:
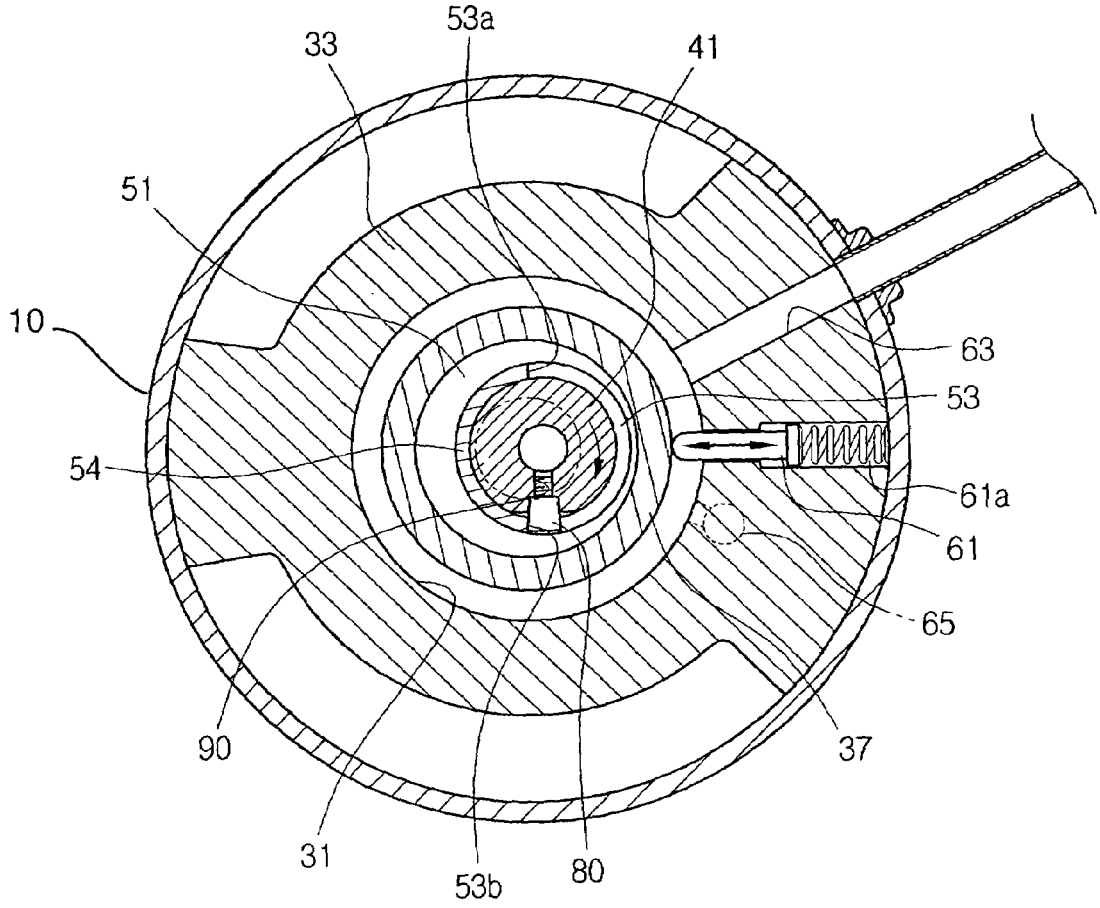
FIG. 8 is equivalent to FIG. 7, showing that compression is not performed in the upper compression chamber by means of the eccentric unit as the rotary shaft is rotated in the second rotating direction.

FIG. 7 is a cross-sectional view showing that compression is performed in the lower compression chamber by means of the eccentric unit as the rotary shaft is rotated in the second rotating direction, and FIG. 8 is equivalent to FIG. 7, showing that compression is not performed in the upper compression chamber by means of the eccentric unit as the rotary shaft is rotated in the second rotating direction.

When the rotary shaft 21 is rotated in the second rotating direction (in the clockwise direction in FIG. 7), as is shown in FIG. 7, compression is performed only in the lower compression chamber 32.

Specifically, the latch pin 80 protruded from the rotary shaft 21 is latched to the second end 53*b* of the slot 53 as the rotary shaft 21 is rotated in the second rotating direction. As a result, the lower eccentric bush 52 and the upper eccentric bush 51 are rotated in the second rotating direction along with the rotary shaft 21.

Consequently, the maximum eccentric part of the lower eccentric cam 42 contacts the maximum eccentric part of the lower eccentric bush 52, and thus the lower eccentric bush 52 is rotated while being maximally eccentric from the center line C1—C1 of the rotary shaft 21. As a result, the lower roller 38 is rotated while contacting the inner circumference of the housing 33 defining the lower compression chamber 32, and therefore compression is performed.

At the same time, the maximum eccentric part of the upper eccentric cam 41 contacts the minimum eccentric part of the upper eccentric bush 51, as is shown in FIG. 8, and thus the upper eccentric bush 51 is rotated while being concentric to the center line C1—C1 of the rotary shaft 21. As a result, the upper roller 37 is rotated while being spaced a predetermined distance from the inner circumference of the housing 33 defining the upper compression chamber 31, and therefore compression is not performed.

Consequently, a gas refrigerant introduced into the lower compression chamber 32 having the relatively small capacity through the lower inlet 64 is compressed by means of the lower roller 38, and is then discharged through the lower outlet 66. On the other hand, the compression is not performed in the upper compression chamber 31 having the relatively large capacity. Consequently, the rotary compressor is operated with a small compression capacity.

As apparent from the above description, the exemplary embodiments of the present invention provide a variable capacity rotary compressor that is capable of selectively performing compression in one of upper and lower compression chambers with different capacities by means of an eccentric unit disposed at a rotary shaft for performing forward or reverse rotation. Consequently, the exemplary embodiments of the present invention have the effect of reducing energy consumption.

Furthermore, the head part is spaced apart from the inner circumference of the forcible fitting hole in the axial direction of the rotary shaft, and thus the forcible fitting force is not applied in the axial direction of the rotary shaft, whereby flexural deformation of the rotary shaft is effectively prevented.

Although exemplary embodiments of the present invention have been shown and described, the invention is not limited to these exemplary embodiments. It would be appreciated by those of ordinary skill in the art that various changes in form and details may be made therein without departing from the broad principles and spirit of the invention, the scope of which is defined in the claims and their equivalents.

What is claimed is:

1. A variable capacity rotary compressor comprising:

upper and lower compression chambers having different capacities, the upper and lower compression chambers being partitioned from each other;

a rotary shaft extending through the upper and lower compression chambers;

upper and lower eccentric cams fitted on the rotary shaft while being eccentric from the rotary shaft, the upper and lower eccentric cams being disposed in the upper and lower compression chambers, respectively;

upper and lower eccentric bushes disposed on outer circumferences of the upper and lower eccentric cams, respectively;

a slot defined between the upper and lower eccentric bushes;

a latch pin adapted to be latched to one of both ends of the slot depending upon the rotation direction of the rotary shaft, the latch pin comprising a head part; and a fixing hole formed at the rotary shaft for allowing the latch pin to be fixed to the rotary shaft therethrough, the fixing hole comprising a forcible fitting hole for allowing the head part of the latch pin to be forcibly fitted therein;

wherein the head part is spaced apart from an inner circumference of the forcible fitting hole in the axial direction of the rotary shaft when the head part is forcibly fitted in the forcible fitting hole, whereby a forcible fitting force is not applied in the axial direction of the rotary shaft.

2. The compressor according to claim 1, wherein the forcible fitting hole has an elliptical section with a large diameter extending in parallel with the axial direction of the rotary shaft.

3. The compressor according to claim 2, wherein the head part is tapered such that the diameter of the head part is gradually increased from an inner end to an outer end thereof.

4. The compressor according to claim 3, wherein the latch pin further comprises a male screw part, and the fixing hole further comprises a female screw part for allowing the male screw part of the latch pin to be screwed thereinto.

5. The compressor according to claim 1, wherein the forcible fitting hole has a circular section with partial elliptical sections extending in the axial direction of the rotary shaft.

6. The compressor according to claim 5, wherein the head part is tapered such that the diameter of the head part is gradually increased from an inner end to an outer end thereof.

7. The compressor according to claim 6, wherein the latch pin further comprises a male screw part, and the fixing hole further comprises a female screw part for allowing the male screw part of the latch pin to be screwed thereinto.

8. A variable capacity rotary compressor comprising:

upper and lower compression chambers having different capacities, the upper and lower compression chambers being partitioned from each other;

a rotary shaft extending through the upper and lower compression chambers;

upper and lower eccentric cams fitted on the rotary shaft while being eccentric from the rotary shaft, the upper and lower eccentric cams being disposed in the upper and lower compression chambers, respectively;

upper and lower eccentric bushes disposed on outer circumferences of the upper and lower eccentric cams, respectively;

a slot defined between the upper and lower eccentric bushes;

a latch pin adapted to be latched to one of both ends of the slot depending upon the rotation direction of the rotary shaft, the latch pin comprising a head part; and a fixing hole formed at the rotary shaft for allowing the latch pin to be fixed to the rotary shaft therethrough, the fixing hole comprising a forcible fitting hole for allowing the head part of the latch pin to be forcibly fitted therein;

wherein the forcible fitting hole has a vertical length extending in the axial direction of the rotary shaft greater than a horizontal length extending in the circumferential direction of the rotary shaft.

9. The compressor according to claim 8, wherein the forcible fitting hole has an elliptical section with a large diameter extending in parallel with the axial direction of the rotary shaft.

10. The compressor according to claim 8, wherein the forcible fitting hole has a circular section with partial elliptical sections extending in the axial direction of the rotary shaft.

* * * * *